US011053946B2

(12) United States Patent
Chang et al.

(10) Patent No.: US 11,053,946 B2
(45) Date of Patent: Jul. 6, 2021

(54) MIXED-FLOW FAN

(71) Applicant: DELTA ELECTRONICS, INC., Taoyuan (TW)

(72) Inventors: Shun-Chen Chang, Taoyuan (TW); Shih-Di Chen, Taoyuan (TW); Chao-Fu Yang, Taoyuan (TW)

(73) Assignee: DELTA ELECTRONICS, INC., Taoyuan (TW)

( * ) Notice: Subject to any disclaimer, the term of this patent is extended or adjusted under 35 U.S.C. 154(b) by 279 days.

(21) Appl. No.: 16/251,937

(22) Filed: Jan. 18, 2019

(65) Prior Publication Data

US 2019/0154042 A1 May 23, 2019

Related U.S. Application Data

(63) Continuation-in-part of application No. 15/944,125, filed on Apr. 3, 2018, now Pat. No. 10,557,476.

(30) Foreign Application Priority Data

Sep. 14, 2017 (CN) ..... 201710829145.6

(51) Int. Cl.
*F04D 19/00* (2006.01)
*F04D 29/62* (2006.01)
(Continued)

(52) U.S. Cl.
CPC ..... *F04D 19/002* (2013.01); *F04D 17/06* (2013.01); *F04D 25/0613* (2013.01);
(Continued)

(58) Field of Classification Search
CPC .... F04D 19/002; F04D 17/06; F04D 25/0613; F04D 25/08; F04D 29/526; F04D 29/626
See application file for complete search history.

(56) References Cited

U.S. PATENT DOCUMENTS 5,193,608 A * 3/1993 Sekine ..... B60K 11/08 123/41.49
7,946,805 B2 * 5/2011 Yoshida ..... H05K 7/20727 415/66
(Continued)

FOREIGN PATENT DOCUMENTS

EP 2691655 A1 2/2014
JP H0988897 A 3/1997
(Continued)

OTHER PUBLICATIONS

Office Action of corresponding CN application No. 201910047647.2 dated Dec. 19, 2020, 8 pages.
(Continued)

*Primary Examiner* — Aaron R Eastman
(74) *Attorney, Agent, or Firm* — Muncy, Geissler, Olds & Lowe, PC

(57) ABSTRACT

A mixed flow fan includes a bottom base, an outer cover disposed on the bottom base, a motor disposed on the base, and a hub located between the outer case and the motor. The hub includes a first outer surface and a second outer surface connected to the first outer surface and inclined relative to the first outer surface. The slope of the first outer surface relative to the central axis is greater than the slope of the second outer surface relative to the central axis. The base includes a side surface adjacent to the second outer surface. The slope of the side surface relative to the central axis is equal to the slope of the second outer surface relative to the central axis.

20 Claims, 9 Drawing Sheets

(51) Int. Cl.

| | |
|---|---|
| ***F04D 25/08*** | (2006.01) |
| ***F04D 29/52*** | (2006.01) |
| ***F04D 17/06*** | (2006.01) |
| ***F04D 25/06*** | (2006.01) |

(52) U.S. Cl.
CPC ..... *F04D 25/08* (2013.01); *F04D 29/526* (2013.01); *F04D 29/626* (2013.01)

(56) References Cited

U.S. PATENT DOCUMENTS

| | | | | |
|---|---|---|---|---|
| 2006/0045738 | A1* | 3/2006 | Lee | F04D 25/0613 415/220 |
| 2014/0023510 | A1 | 1/2014 | Ruck | |
| 2016/0032942 | A1 | 2/2016 | Jung et al. | |
| 2016/0290352 | A1* | 10/2016 | Hayamitsu | F04D 29/4233 |

FOREIGN PATENT DOCUMENTS

| | | | |
|---|---|---|---|
| JP | H114559 | A | 1/1999 |
| JP | H1141859 | A | 2/1999 |
| KR | 20140049101 | A | 4/2014 |
| WO | WO-2012130405 | A1 | 10/2012 |

OTHER PUBLICATIONS

Office Action of its related CN application No. 201710829145.6 dated Dec. 18, 2019, 7 pages.
Search Report of its related EP application No. 18174878.1 dated Nov. 28, 2018, 8 pages.

* cited by examiner

MIXED-FLOW FAN

CROSS-REFERENCE TO RELATED APPLICATIONS

This application is a Continuation-In-Part of pending U.S. patent application Ser. No. 15/944,125, filed on Apr. 3, 2018, which claims priority of China Patent Application No. 201710829145.6, filed on Sep. 14, 2017, the entirety of which is incorporated by reference herein.

BACKGROUND OF THE INVENTION

Field of the Invention

The present disclosure relates to a fan, and in particular to a mixed-flow fan.

Description of the Related Art

The size of today's automotive electronics systems is shrinking, and fans need to provide the most efficient heat dissipation in a limited installation space to meet consumers' needs. Although the strength of the air flow from a conventional axial fan is great, it often cannot be used in electronics systems due to the restrictions on the thickness and the air-flow direction of the electronic system's inlet and outlet.

The restrictions on the air-flow direction of the inlet and outlet can be overcome by using centrifugal fans (blowers). However, the strength of the air flow produced by centrifugal fans is low, and it is difficult to achieve the required cooling performance.

Although the fans have been generally adequate for their intended purposes, they have not been entirely satisfactory in all respects. Consequently, it is desirable to provide a solution for improving fans.

BRIEF SUMMARY OF THE INVENTION

The disclosure provides a mixed-flow fan. The strength of the air flow of the mixed-flow fan is somewhere between the strength of the air flow of an axial fan and that of a centrifugal fan. Not only does the mixed-flow fan have good heat dissipation, but it also meets flow-direction requirements.

The disclosure provides a mixed-flow fan including a base, an outer cover, a motor, and a hub. The outer cover is disposed on the base. The motor is disposed on the base, and located in the outer cover. The hub is disposed on the base, and located between the outer cover and the motor. The hub is configured to rotate about a central axis.

The hub includes a first outer surface and a second outer surface connected to the first outer surface and inclined relative to the first outer surface. The slope of the first outer surface relative to the central axis is greater than the slope of the second outer surface relative to the central axis. The base includes a first side surface adjacent to the second outer surface. The slope of the first side surface relative to the central axis is equal to the slope of the second outer surface relative to the central axis. In some embodiments, the area of the first outer surface is from 2 times to 10 times the area of the second outer surface. In some embodiments, the mixed-flow fan further includes a blade connected to the first outer surface and the second outer surface.

In some embodiments, the blade further includes a first edge and a second edge connected to the first edge and inclined relative to the first edge. The slope of the first edge relative to the central axis is greater than the slope of the second edge relative to the central axis.

In some embodiments, the second edge is closer to the base than the first edge, and the length of the first edge is 2 times longer than the length of the second edge.

In some embodiments, the base includes a bottom channel, and a main channel is formed between the outer cover and the hub and connected to the bottom channel. The main channel substantially extends in a first direction, the bottom channel substantially extends in a second direction. A first interior angle between the first direction and the central axis is greater than a second interior angle between the second direction and the central axis.

In some embodiments, the main channel includes a main inlet and a main outlet opposite to the main inlet, and the main outlet is connected to the bottom channel, the main channel gradually narrows from the main inlet to the main outlet.

In some embodiments, the main inlet and the main outlet are ring-shaped. The first interior angle is greater than 20 degrees, and the second interior angle is less than 15 degrees.

In some embodiments, the outer cover includes a first inner surface facing the first outer surface and a second inner surface facing the second outer surface. The slope of the first inner surface relative to the central axis is greater than the slope of the second inner surface relative to the central axis. In some embodiments, the first outer surface is a concave surface, and the first inner surface is a convex surface.

In some embodiments, the base includes a first base body, a second base body, and a support rib. The motor is disposed on the first base body. The second base body is surrounding the first base body and separated from the first base body. The support rib is connected to the first base body and the second base body. The bottom channel is formed between the first base body and the second base body, and the support rib is located in the bottom channel.

In some embodiments, the mixed-flow fan further includes a circuit board electrically connected to the motor, wherein the first base body includes a receiving groove, and the circuit board is located in the receiving groove.

In some embodiments, the thickness of the mixed-flow fan is less than 10 times thicker than the depth of the receiving groove. Depth and thickness are measured in a longitudinal direction parallel to the central axis.

In some embodiments, the diameter of the first base body is 1.6 times greater than the diameter of the motor. The diameter of the first base body and the diameter of the motor are measured in a transversal direction perpendicular to the central axis.

In some embodiments, the first base body includes the first side surface, and the second base body includes a second side surface facing the first side surface. The bottom channel is formed between the first side surface and the second side surface. A first angle between an extension direction of the first side surface and the central axis is less than or equal to a second angle between the extension direction of the second side surface and the central axis.

In some embodiments, the second base body is a ring structure perpendicular to the central axis. The blade is a wing-shaped structure, and the blade includes various thicknesses.

The disclosure provides a mixed-flow fan including a base, an outer cover, a motor, a hub, and a blade. The outer cover is disposed on the base. The motor is disposed on the base, and located in the outer cover. The hub is located between the outer cover and the motor. The hub is configured to rotate about a central axis, and includes an outer surface. The blade is connected to the outer surface.

The base includes a first side surface adjacent to the outer surface. The slope of the outer surface relative to the central axis is greater than the slope of the first side surface relative to the central axis. The blade further includes a first edge, and a second edge connected to the first edge and inclined relative to the first edge. The slope of the first edge relative to the central axis is greater than the slope of the second edge relative to the central axis.

In some embodiments, the second edge is closer to the base than the first edge. The length of the first edge is 2 times longer than the length of the second edge. The base further includes a second side surface facing the first side surface, and the second side surface is inclined relative to the first side surface.

In conclusion, depending on the design of the main channel and of the bottom channel of the mixed-flow fan of the disclosure, the mixed-flow fan of the disclosure has better air flow than a conventional centrifugal fan.

BRIEF DESCRIPTION OF THE DRAWINGS

The invention can be more fully understood by reading the subsequent detailed description and examples with references made to the accompanying drawings, wherein.

DETAILED DESCRIPTION OF THE INVENTION

The following disclosure provides many different embodiments, or examples, for implementing different features of the present disclosure. Specific examples of components and arrangements are described below to simplify the present disclosure. For example, the formation of a first feature over or on a second feature in the following description may include embodiments in which the first and second features are formed in direct contact, and may also include embodiments in which additional features could be formed between the first and second features, such that the first and second features may not be in direct contact.

Spatially relative terms, such as upper and lower, may be used herein for ease of description to describe one element or feature's relationship to another element(s) or feature(s) as illustrated in the figures. The spatially relative terms are intended to encompass different orientations of the device in use or operation in addition to the orientation depicted in the figures.

Figure 1:
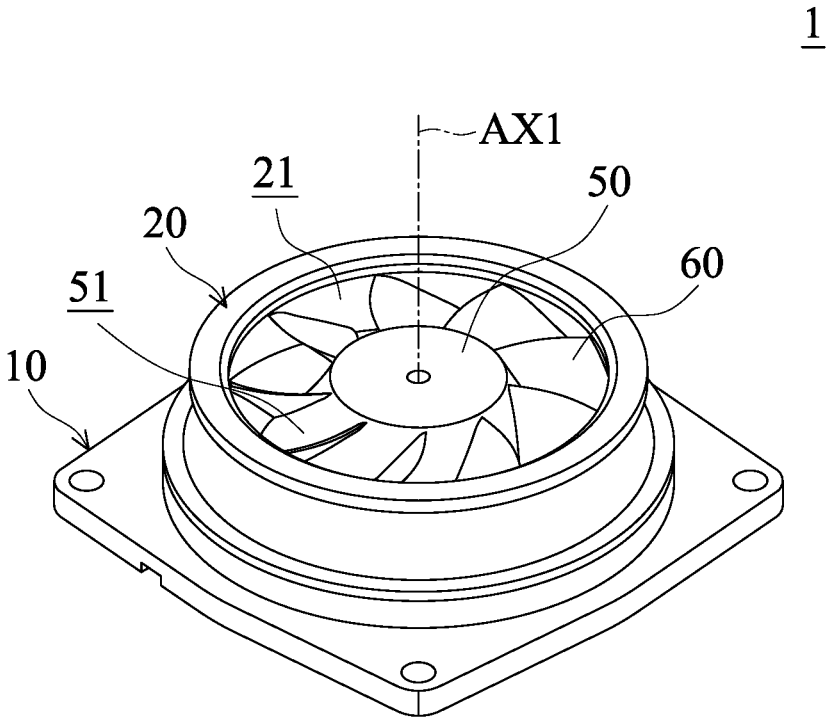
FIG. 1 is a perspective view of a mixed-flow fan in accordance with the first embodiment of the present disclosure.
Figure 2:
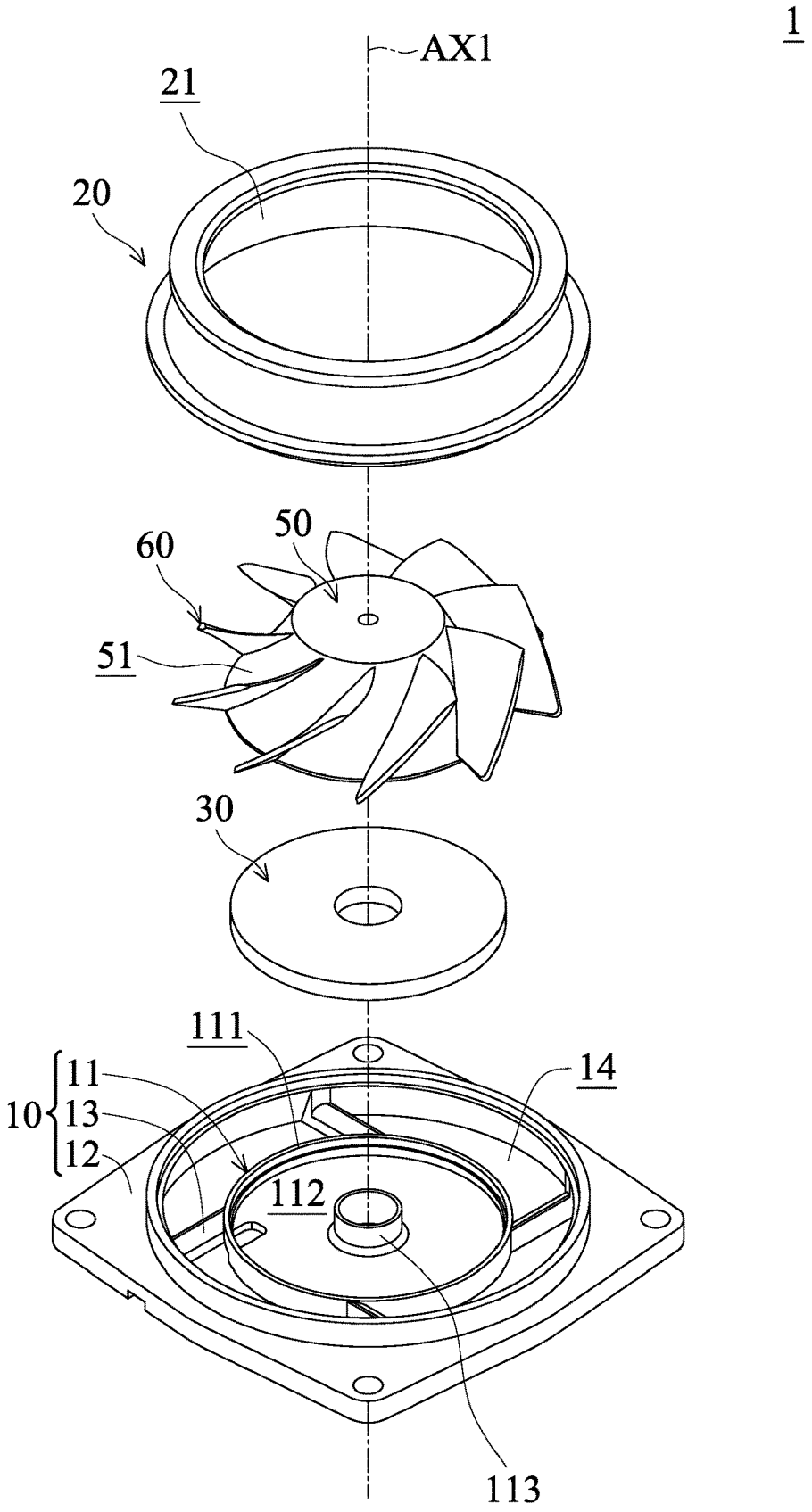
FIG. 2 is an exploded view of the mixed-flow fan in accordance with the first embodiment of the present disclosure.
Figure 3:
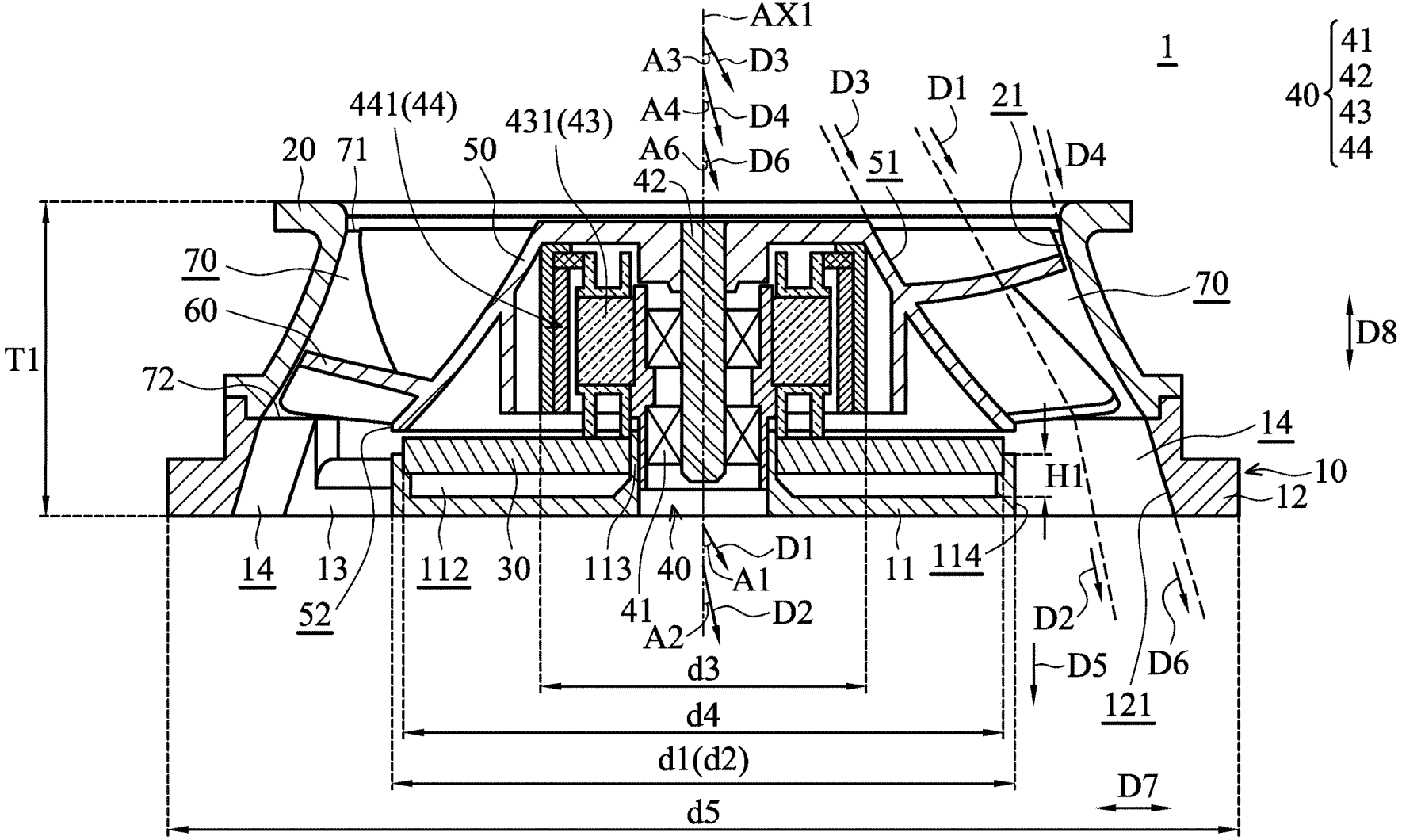
FIG. 3 is a cross-sectional view of the mixed-flow fan in accordance with the first embodiment of the present disclosure.

FIG. 1 is a perspective view of a mixed-flow fan 1 in accordance with the first embodiment of the present disclosure. FIG. 2 is an exploded view of the mixed-flow fan 1 in accordance with the first embodiment of the present disclosure. FIG. 3 is a cross-sectional view of the mixed-flow fan 1 in accordance with the first embodiment of the present disclosure. The mixed-flow fan 1 includes a base 10, an outer cover 20, a circuit board 30, a motor 40, a hub 50 and blades 60.

The outer cover 20 is disposed on the base 10. The circuit board 30 is disposed on the base 10, and located in the outer cover 20. The motor 40 is disposed on the circuit board 30, and electrically connected to the circuit board 30. The hub 50 is located between the outer cover 20 and the motor 40, and the blades 60 are connected to the hub 50. The motor 40 drives the hub 50 and the blades 60 to rotate so that an air flow is generated by the blades 60.

The base 10 is substantially a plate structure. In this embodiment, a central axis AX1 passes through the center of the base 10, and the base 10 extends substantially perpendicular to the central axis AX1. In some embodiments, the material of the base 10 is plastic. The base 10 includes a first base body 11, a second base body 12, and support ribs 13.

The first base body 11 is substantially a plate structure, and extends substantially perpendicular to the central axis AX1. In this embodiment, the first base body 11 is substantially a disk structure. The first base body 11 includes a support surface 111, a receiving groove 112, and a sleeve 113. The support surface 111 is the main surface of the first base body 11, and faces the hub 50.

The receiving groove 112 is formed on the support surface 111. In this embodiment, the receiving groove 112 is ring-shaped, and the central axis AX1 passes through the center of the receiving groove 112. The sleeve 113 is disposed on the bottom of the receiving groove 112, and extends along a central axis AX1. In this embodiment, the sleeve 113 is a hollow columnar structure, and the central axis AX1 passes through the center of the sleeve 113.

The second base body 12 may be a ring structure, and substantially extends perpendicular to the central axis AX1. The central axis AX1 passes through the center of the second base body 12. The second base body 12 is around the first base body 11, and separated from the first base body 11.

The support ribs 13 are connected to the first base body 11 and the second base body 12. In this embodiment, there are four support ribs 13, but it is not limited thereto. In some embodiments, there are three, or at least five, support ribs 13.

A bottom channel 14 is formed between the first base body 11 and the second base body 12. The bottom channel 14 may be a ring shape surrounding the first base body 11. The support ribs 13 are located in the bottom channel 14. In some embodiments, the volume of each of the support ribs 13 is less than 0.3 times the volume of the bottom channel 14.

In this embodiment, the first base body 11, the support ribs 13 and the second base body 12 are made of plastic, and are formed as a single piece.

The outer cover 20 may be a ring structure, and is disposed on the second base body 12. The central axis AX1 passes through the center of the outer cover 20. Some elements, such as the motor 40, the hub 50, and the blades 60 are located in the outer cover 20. In some embodiments, the second base body 12 is a portion of the outer cover 20, and the second base body 12 is affixed to the support rib 13.

As shown FIGS. 2 and 3, the circuit board 30 is electrically connected to the motor 40, and located in the receiving groove 112 of the first base body 11. In this embodiment, the circuit board 30 is a ring structure, and substantially extends perpendicular to the central axis AX1. The central axis AX1 passes through the center of the circuit board 30.

As shown in FIG. 3, the diameter d1 of the first base body 11 is substantially equal to the greatest diameter d2 of the hub 50. Therefore, the first base body 11 does not block the air flow generated by the mixed-flow fan 1. In this embodiment, the diameter d1 of the first base body 11 is 1.6 times, 1.7 times, or 1.8 times longer than the diameter d3 of the motor 40. In some embodiments, the diameter d1 of the first base body 11 and the greatest diameter d2 of the hub 50 is about 41 mm. The diameter d3 of the motor 40 is about 22.8 mm. The diameter d1 of the first base body 11, the greatest diameter d2 of the hub 50, and the diameter d3 of the motor 40 are measured in a transversal direction D7 perpendicular to the central axis AX1.

In some embodiments, the diameter d5 of the base 10 is about 75 mm. The diameter d5 of the base 10 is 2.8 times, 3.0, times or 3.2 times longer than the diameter d3 of the motor 40. The diameter d4 of the receiving groove 112 is about 39 mm. The diameter d4 of the receiving groove 112 is slightly shorter than the diameter d1 of the first base body 11. In other words, the diameter d4 of the receiving groove 112 is 1.6 times, 1.7, times or 1.8 times longer than the diameter d3 of the motor 40.

In some embodiments, the depth H1 of the receiving groove 112 is about 2.5 mm. The diameter d4 of the receiving groove 112 is 15 times, 16 times or 17 times longer than the depth H1 of the receiving groove 112. The thickness T1 of the mixed-flow fan 1 is about 22 mm. The thickness T1 of the mixed-flow fan 1 is less than 8 times, 9 times or 10 times the depth H1 of the receiving groove 112. The depth H1 and the thickness T1 are measured in a longitudinal direction D8 parallel to the central axis AX1.

Therefore, due to the structures of the hub 50 and the base 10, a greater volume of the receiving groove 112 can be formed in the first base body 11. Therefore, the circuit board 30 and more electronic elements can be disposed in the receiving groove 112.

As shown in FIG. 3, the motor 40 is located over the circuit board 30, and electrically connected to the circuit board 30. The circuit board 30 is configured to transmit a driving signal to the motor 40, and the motor 40 rotates the hub 50 according to the driving signal.

In this embodiment, the motor 40 is disposed on the first base body 11, and includes a bearing 41, a shaft 42, a stator 43, and a rotor 44. The bearing 41 is affixed in the sleeve 113. The shaft 42 is rotatably disposed in the bearing 41, and extends along the central axis AX1. The shaft 42 can be rotated about the central axis AX1, and the end of the shaft 42 is affixed in the hub 50.

The stator 43 is disposed on the circuit board 30, and electrically connected to the circuit board 30. In this embodiment, the stator 43 is affixed to the sleeve 113. The rotor 44 is affixed in the hub 50, and around the stator 43. In this embodiment, the rotor 44 is adjacent to the stator 43, and can be rotated relative to the stator 43. In some embodiments, the stator 43 includes electromagnets 431, and the rotor 44 includes permanent magnets 441. Due to the magnetic force between the stator 43 and the rotor 44, the stator 43 drives the rotor 44 to rotate about the central axis AX1, and thus the hub 50 and the blades 60 are rotated.

The hub 50 covers the outer side and the top of the motor 40, and can be rotated about the central axis AX1. The hub 50 is located in the outer cover 20. A main channel 70 is formed between the outer cover 20 and the hub 50. The main channel 70 is in commutation with the bottom channel 14 of the base 10. In this embodiment, the main channel 70 is ring-shaped, and surrounds the hub 50. The main channel 70 includes a main inlet 71 and a main outlet 72 opposite to the main inlet 71. The main outlet 72 is connected to the bottom channel 14.

In this embodiment, the main inlet 71 and the main outlet 72 are ring-shaped. The central axis AX1 passes through the centers of the main inlet 71 and the main outlet 72. The main inlet 71 and the main outlet 72 extend perpendicular to the central axis AX1. In some embodiments, the area of the main inlet 71 is equal to or substantially equal to the main outlet 72. The main channel 70 gradually narrows from the main inlet 71 to the main outlet 72.

When the blade 60 is rotated, the blades 60 generate an air flow. The air flow enters into the mixed-flow fan 1 and the main channel 70 via the main inlet 71, and enters into the bottom channel 14 of the base via the main outlet 72. Since of the structure of the main channel 70, the air flow can smoothly pass through the main channel 70.

In this embodiment, the main channel 70 substantially extends in the first direction D1, and the bottom channel 14 substantially extends in the second direction D2. A first interior angle A1 between the first direction D1 and the central axis AX1 is greater than a second interior angle A2 between the second direction D2 and the central axis AX1. The first direction D1 and the second direction D2 can pass through the central axis AX1, and the first direction D1, the second direction D2 and the central axis AX1 are located on the same plane. Depending on the design of the main channel 70 and of the bottom channel 14, the strength of the air flow of the mixed-flow fan 1 is improved.

Figure 5:
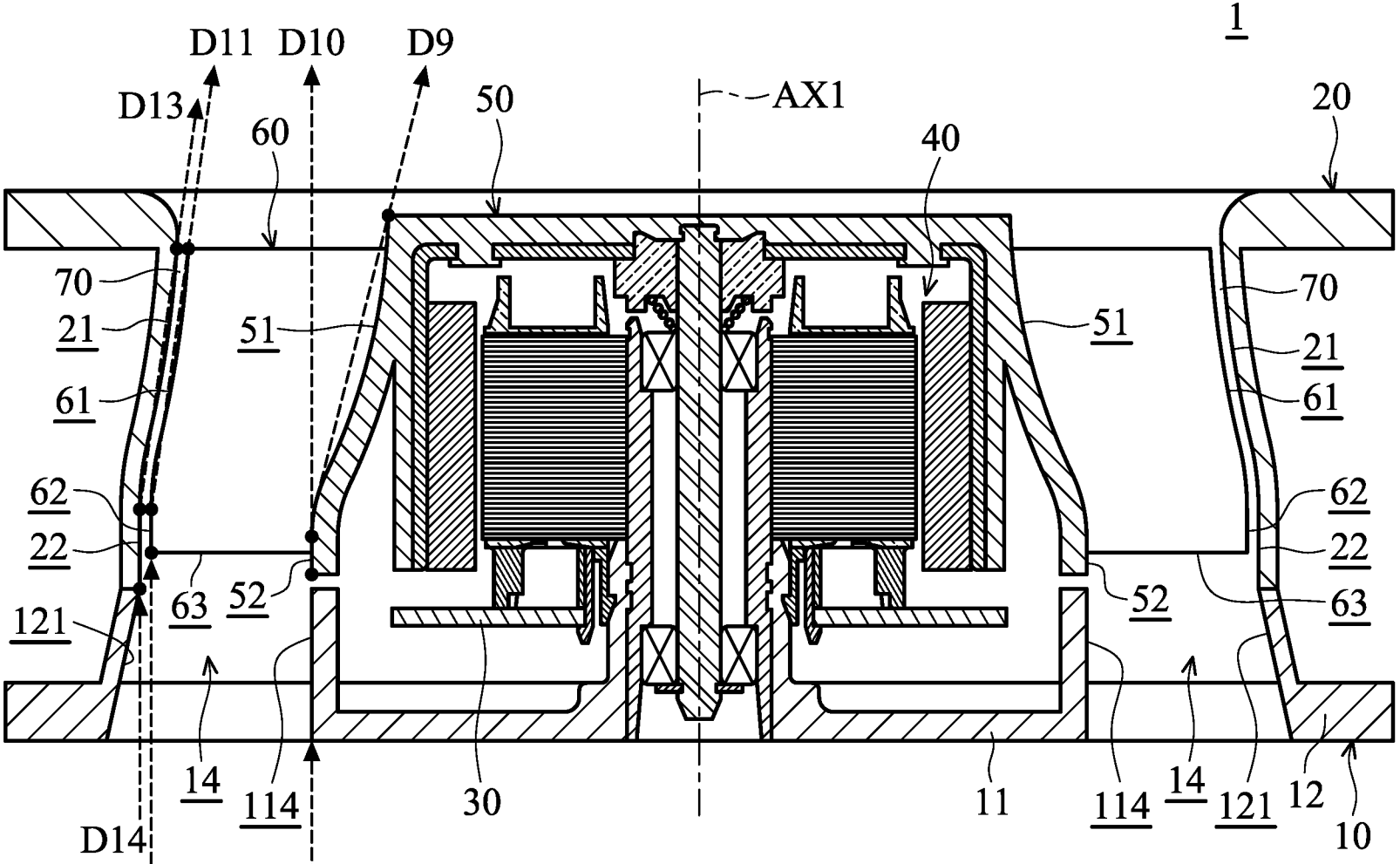
FIG. 5 is a cross-sectional view of the mixed-flow fan in accordance with the second embodiment of the present disclosure.

In some embodiments, the first interior angle A1 is greater than 20 degrees, and the second interior angle A2 is less than 15 degrees. In some embodiments, the first interior angle A1 is about 30 degrees, and the second interior angle A2 is about 10 degrees. In some embodiments as shown in FIG. 5, the second interior angle A2 is about 0 degrees. In other words, the second direction D2 is parallel to the central axis AX1.

In this embodiment, the hub 50 includes an outer surface 51, and the outer cover 20 includes an inner surface 21 facing the outer surface 51. The outer surface 51 and the inner surface 21 are ring-shaped. The main channel 70 is formed between the outer surface 51 and the inner surface 21. The outer surface 51 may be a concave surface, and the inner surface 21 may be a convex surface. The strength of the air flow of the mixed-flow fan 1 can be improved.

In some embodiments, the first direction D1 is along a straight line from a first middle point between the top of the inner surface 21 and the top of the outer surface 51 to a second middle point between the bottom of the inner surface 21 and the bottom of the outer surface 51 in a cross section of the fan 1 passing through the central axis AX1.

As shown in FIG. 3, the slope of the inner surface 21 is greater than the slope of the outer surface 51. The outer surface 51 of the hub 50 extends or substantially extends along an extension direction D3. In some embodiments, the extension direction D3 is along a straight line from a top point to a bottom point of the outer surface 51 in the cross section of the fan 1 passing through the central axis AX1. The inner surface 21 of the outer cover 20 extends or substantially extends along an extension direction D4. In some embodiments, the extension direction D4 is along a straight line from a top point to a bottom point of the inner surface 21 in the cross section of the fan 1 passing through the central axis AX1.

An angle A3 between the extension direction D3 of the outer surface 51 and the central axis AX1 is greater than an angle A4 between the extension direction D4 of the inner surface 21 and the central axis AX1. In some embodiments, the angle A3 is greater than 40 degrees, and the angle A4 is less than 30 degrees. Moreover, in some embodiments, the angle A3 is greater than the first interior angle A1, and the angle A4 is less than the first interior angle A1. The extension direction D3 and the extension direction D4 can pass through the central axis AX1, and the extension direction D3, the extension direction D4, and the central axis AX1 are located on the same plane.

The first base body 11 includes a first side surface 114. The second base body 12 includes a second side surface 121 facing the first side surface 114. The first side surface 114 and the second side surface 121 are ring-shaped. The bottom channel 14 is formed between the first side surface 114 and the second side surface 121.

As shown in FIG. 3, the slope of the first side surface 114 is greater than the slope of the second side surface 121. An angle between the extension direction D5 of the first side surface 114 and the central axis AX1 is less than or equal to the angle A6 between the extension direction D6 of the second side surface 121 and the central axis AX1. In some embodiments, the angle between the extension direction D5 and the central axis AX1 is less than 8 degrees, and the angle A6 is less than 20 degrees. In other words, the second side surface 121 is inclined relative to the first side surface 114.

In some embodiments, the angle between the extension direction D5 and the central axis AX1 is equal to the angle A6. In other words, the first side surface 114 is parallel to the second side surface 121. In some embodiments, the angle between the extension direction D5 and the central axis AX1 and the angle A6 are 0 degree. In other words, the first side surface 114 and the second side surface 121 extend parallel to the central axis AX1.

Moreover, in some embodiments, the angle A6 is greater than the second interior angle A2, and the angle between the extension direction D5 and the central axis AX1 is less than the second interior angle A2. In some embodiments, the angle A3 and the angle A4 are greater than the angle between the extension direction D5 and the central axis AX1, and greater than the angle A6. The extension direction D5 and the extension direction D6 can pass through the central axis AX1. Moreover, the extension direction D5, the extension direction D6, and the central axis AX1 are located on the same plane.

In this embodiment, the hub 50 further includes an outer surface 52. The outer surface 52 is connected to the outer surface 51 adjacent to the first base body 11. The outer surface 52 may be ring-shaped. The diameter of the outer surface 52 is equal to the diameter d1 of the first base body 11. The outer surface 52 and the first side surface 114 extend along the same extension direction D5. Due to the outer surface 52, the air flow smoothly enters into the bottom channel 14 from the main channel 70.

Figure 4:
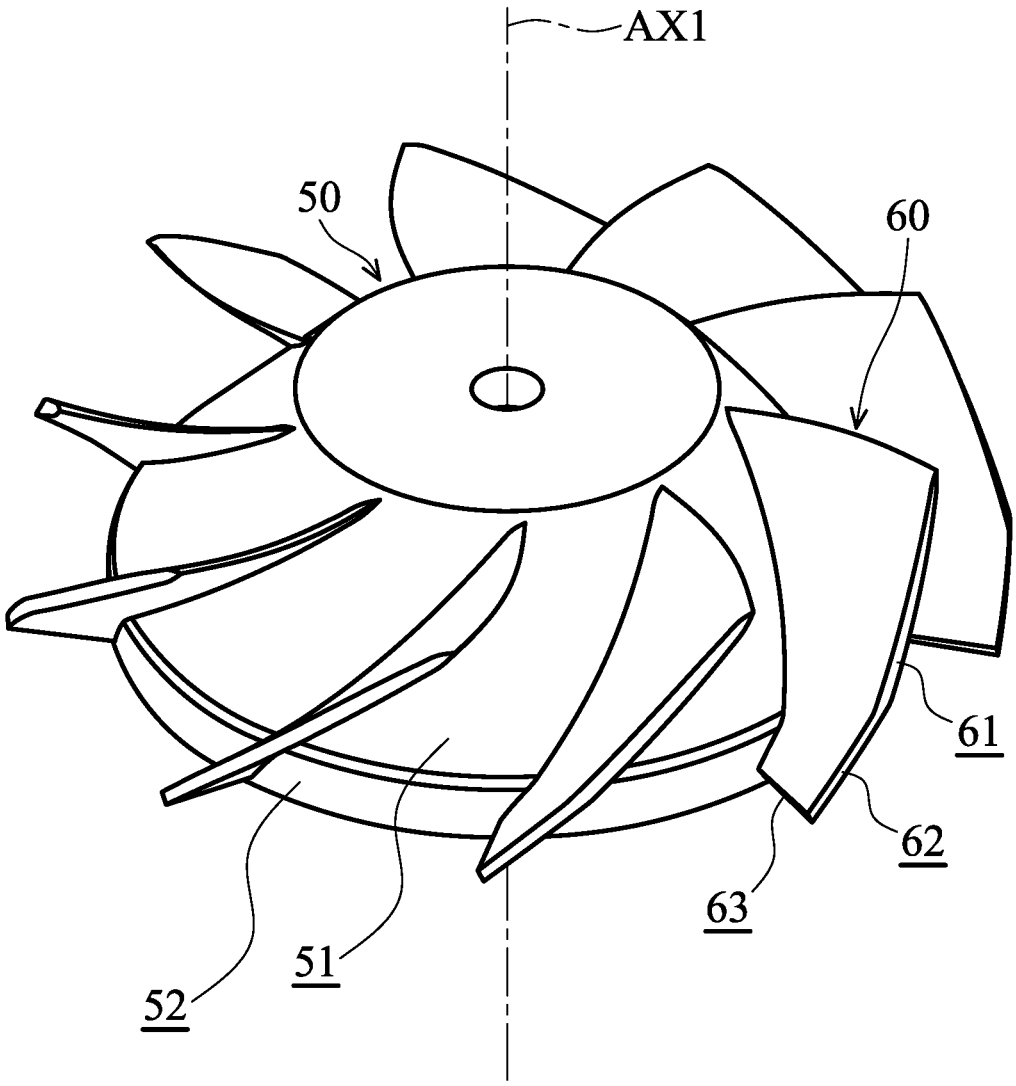
FIG. 4 is a perspective view of the hub and the blades in accordance with the second embodiment of the present disclosure.

FIG. 4 is a perspective view of the hub 50 and the blades 60 in accordance with the second embodiment of the present disclosure. FIG. 5 is a cross-sectional view of the mixed-flow fan 1 in accordance with the second embodiment of the present disclosure. In this embodiment, the hub 50 includes a first outer surface (outer surface) 51 and a second outer surface (outer surface) 52. The first outer surface 51 and the second outer surface 52 may be ring-shaped, and face the outer cover 20. The first outer surface 51 is connected to the second outer surface 52 and inclined relative to the second outer surface 52.

In this embodiment, the slope of the first outer surface 51 relative to the central axis AX1 is greater than the slope of the second outer surface 52 relative to the central axis AX1. The angle between the extension direction D9 of the first outer surface 51 and the central axis AX1 is greater than the angle between the extension direction D10 of the second outer surface 52 and the central axis AX1. The extension direction D9 of the first outer surface 51 is a direction from the highest point of the first outer surface 51 to the junction point between the first outer surface 51 and the second outer surface 52. The extension direction D10 of the second outer surface 52 is a direction from the junction point between the first outer surface 51 and the second outer surface 52 to the lowest point of the second outer surface 52. The area of the first outer surface 51 is from 2 times to 10 times the area of the second outer surface 52. The area of the first outer surface 51 is 2 times greater than the area of the second outer surface 52. In a cross-sectional plane passing through the central axis AX1, the first outer surface 51 may be a concave surface, and the second outer surface 52 may be a plane.

The blade 60 is connected to the first outer surface 51 and the second outer surface 52. The blade 60 further includes a first edge 61, a second edge 62, and a bottom edge 63. The first edge 61 is opposite to the first outer surface 51, and the second edge 62 is opposite to the second outer surface 52. The first edge 61 is connected to the second edge 62, and is inclined relative to the second edge 62. The second edge 62 is closer to the base 10 than the first edge 61. The bottom edge 63 is connected to the second edge 62 and the second outer surface 52. The bottom edge 63 may extend perpendicular to the central axis AX1.

In this embodiment, the slope of the first edge 61 relative to the central axis AX1 is greater than the slope of the second edge 62 relative to the central axis AX1. The angle between the extension direction D11 along the first edge 61 and the central axis AX1 is greater than the angle between the extension direction D12 of the second edge 62 and the central axis AX1. The extension direction D11 of the first edge 61 is a direction from the highest point of the first edge 61 to the junction point between the first edge 61 and the second edge 62. The extension direction D12 of the second edge 62 is a direction from the junction point between the first edge 61 and the second edge 62 to the lowest point of the second edge 62. The length of the first edge 61 is 2 times longer than the length of the second edge 62. In some embodiments, the length of the first edge 61 is from 2 times to 10 times the length of the second edge 62. The length of the first edge 61 may be 2 times longer than the length of the second edge 62.

The outer cover 20 includes a first inner surface (inner surface) 21 and a second inner surface 22. The first inner surface 21 faces the first outer surface 51, and the second inner surface 22 faces the second outer surface 52. The first inner surface 21 and the second inner surface 22 may be ring-shaped. The first inner surface 21 is connected to the second inner surface 22, and inclined relative to the second inner surface 22. Moreover, the first edge 61 faces the first inner surface 21, and the second edge 62 faces the second inner surface 22.

In this embodiment, the slope of the first inner surface 21 relative to the central axis AX1 is greater than the slope of the second inner surface 22 relative to the central axis AX1.

The angle between the extension direction D13 of the first inner surface 21 and the central axis AX1 is greater than the angle between the extension direction D14 of the second inner surface 22 and the central axis AX1. The extension direction D13 of the first inner surface 21 is a direction from an equal high point of the first inner surface 21, which corresponds to the highest point of the first outer surface 51, to the junction point between the first inner surface 21 and the second inner surface 22. The extension direction D14 of the second inner surface 22 is a direction from the junction point between the first inner surface 21 and the second inner surface 22 to the lowest point of the second inner surface 22. Moreover, the slope of the first inner surface 21 relative to the central axis AX1 may be equal to or substantially equal to the slope of the first outer surface 51 relative to the central axis AX1. The angle between the extension direction D13 of the first inner surface 21 and the central axis AX1 is equal to or substantially equal to the angle of the extension direction D9 of the first outer surface 51 and the central axis AX1. The slope of the second inner surface 22 relative to the central axis AX1 may be equal to or substantially equal to the slope of the second outer surface 52 relative to the central axis AX1. The angle between the extension direction D14 of the second inner surface 22 and the central axis AX1 is equal to or substantially equal to the angle between the extension direction D10 of the second outer surface 52 and the central axis AX1.

In this embodiment, the area of the first inner surface 21 is from 2 times to 10 times the area of the second inner surface 22. In a cross-sectional surface passing through the central axis AX1, the first inner surface 21 may be a convex surface, and the second inner surface 22 may be a plane.

As shown in FIG. 5, the first side surface 114 is adjacent to the second outer surface 52. The slope of the first side surface 114 relative to the central axis AX1 may be equal to the slope of the second outer surface 52 relative to central axis AX1. The angle between the extension direction D15 of the first side surface 114 and the central axis AX1 is equal to the angle between the extension direction D10 of the second outer surface 52 and the central axis AX1.

Figure 6:
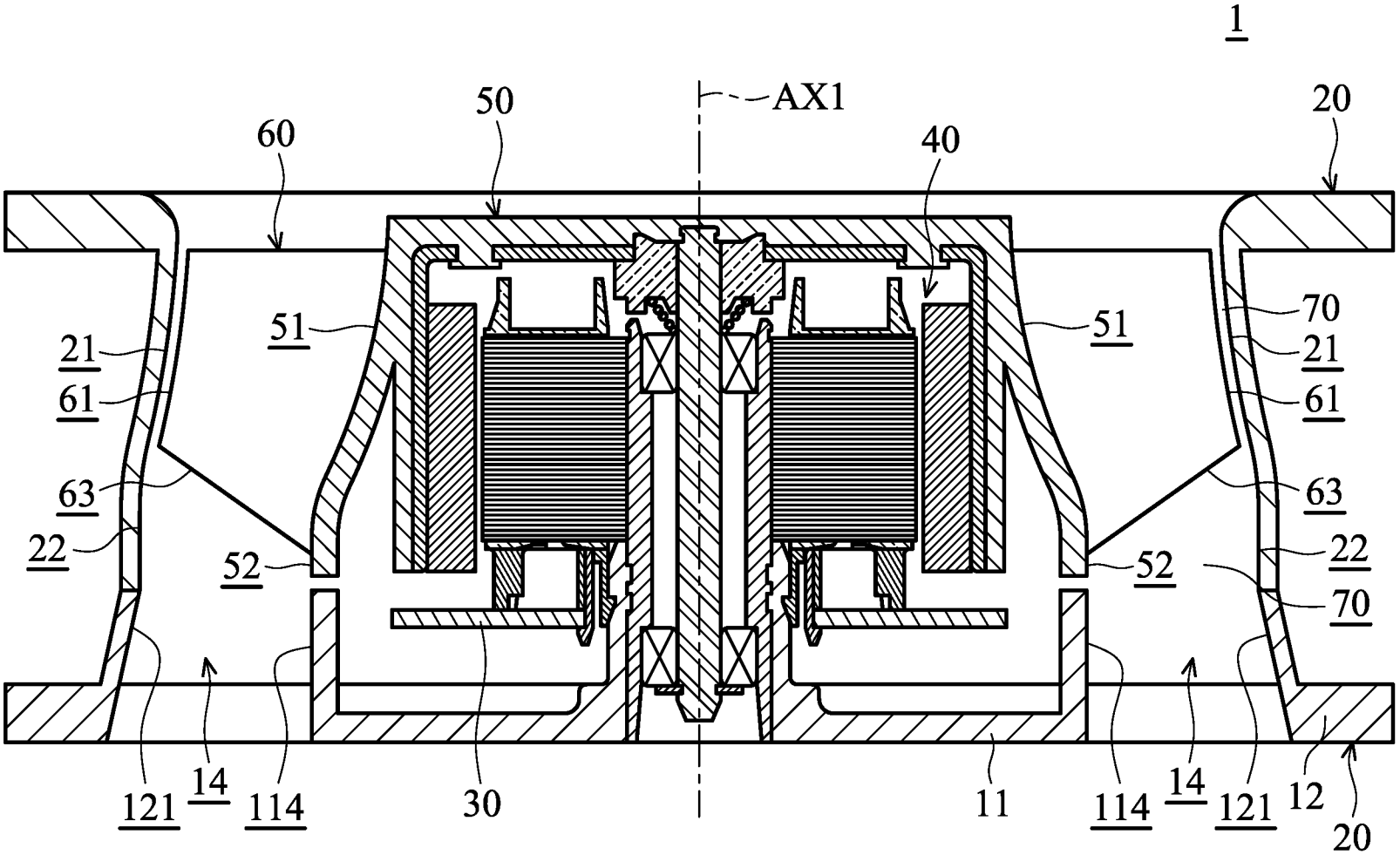
FIG. 6 is a cross-sectional view of the mixed-flow fan in accordance with the third embodiment of the present disclosure.

FIG. 6 is a cross-sectional view of the mixed-flow fan 1 in accordance with the third embodiment of the present disclosure. In the third embodiment, in contrast to the second embodiment, the blade 60 does not include the second edge 62. The bottom edge 63 is connected to the first edge 61 and the second outer surface 52. The second outer surface 52 faces the bottom edge 63.

Figure 7:
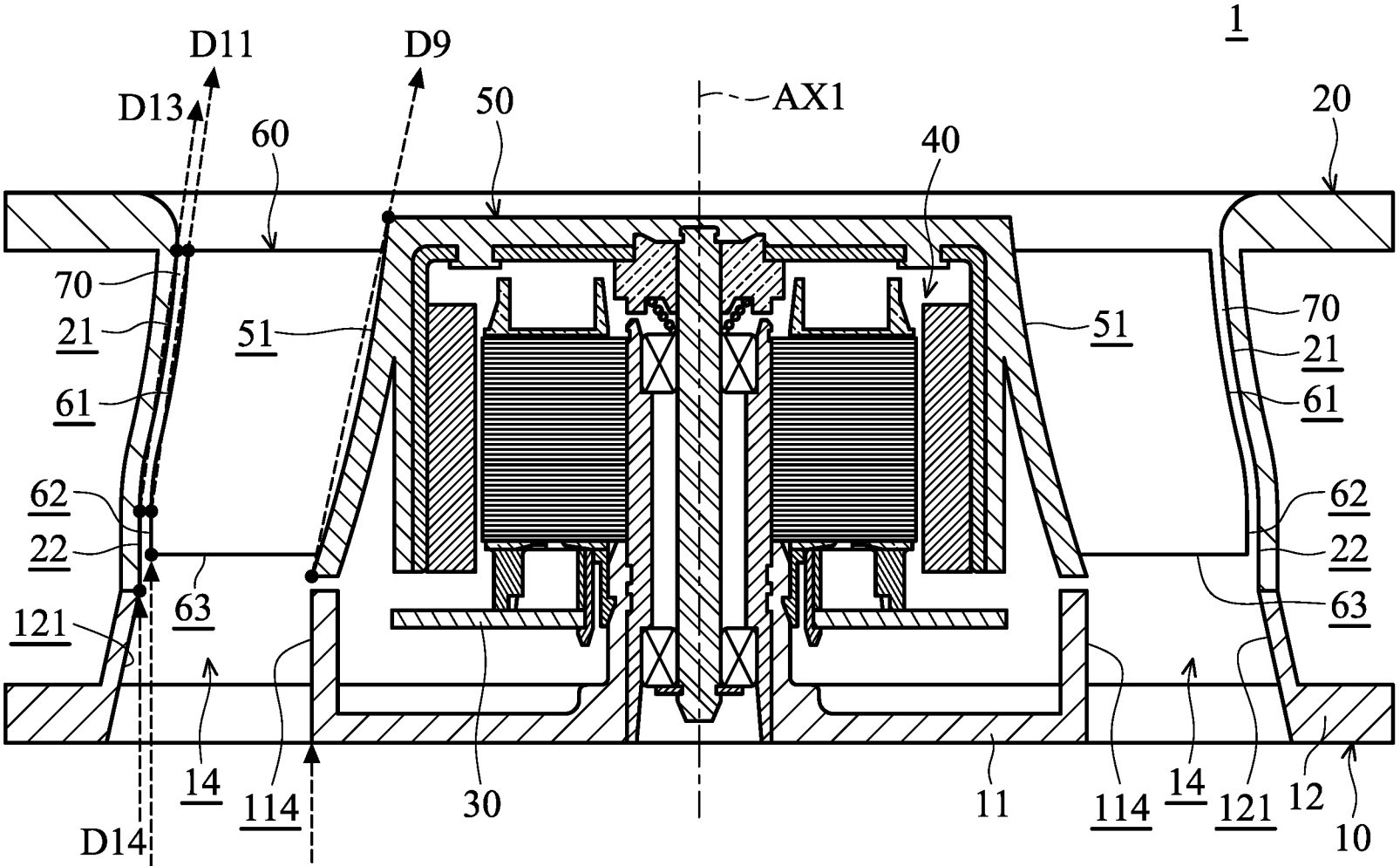
FIG. 7 is a cross-sectional view of the mixed-flow fan in accordance with the fourth embodiment of the present disclosure.

FIG. 7 is a cross-sectional view of the mixed-flow fan 1 in accordance with the fourth embodiment of the present disclosure. In the fourth embodiment, in contrast to the second embodiment, the hub 50 does not include the second outer surface 52. The blades 60 are connected to the outer surface 51. The first side surface 114 of the base 10 is adjacent to the outer surface 51. The slope of the outer surface 51 relative to the central axis AX1 is greater than the slope of the first side surface 114 relative to the central axis AX1. The angle between the extension direction D9 of the outer surface 51 and the central axis AX1 is greater than the angle between the extension direction D15 of the first side surface 114 and the central axis AX1. The extension direction D9 of the outer surface 51 is a direction from the highest point of the outer surface 51 to the lowest point of the outer surface 51.

Figure 8:
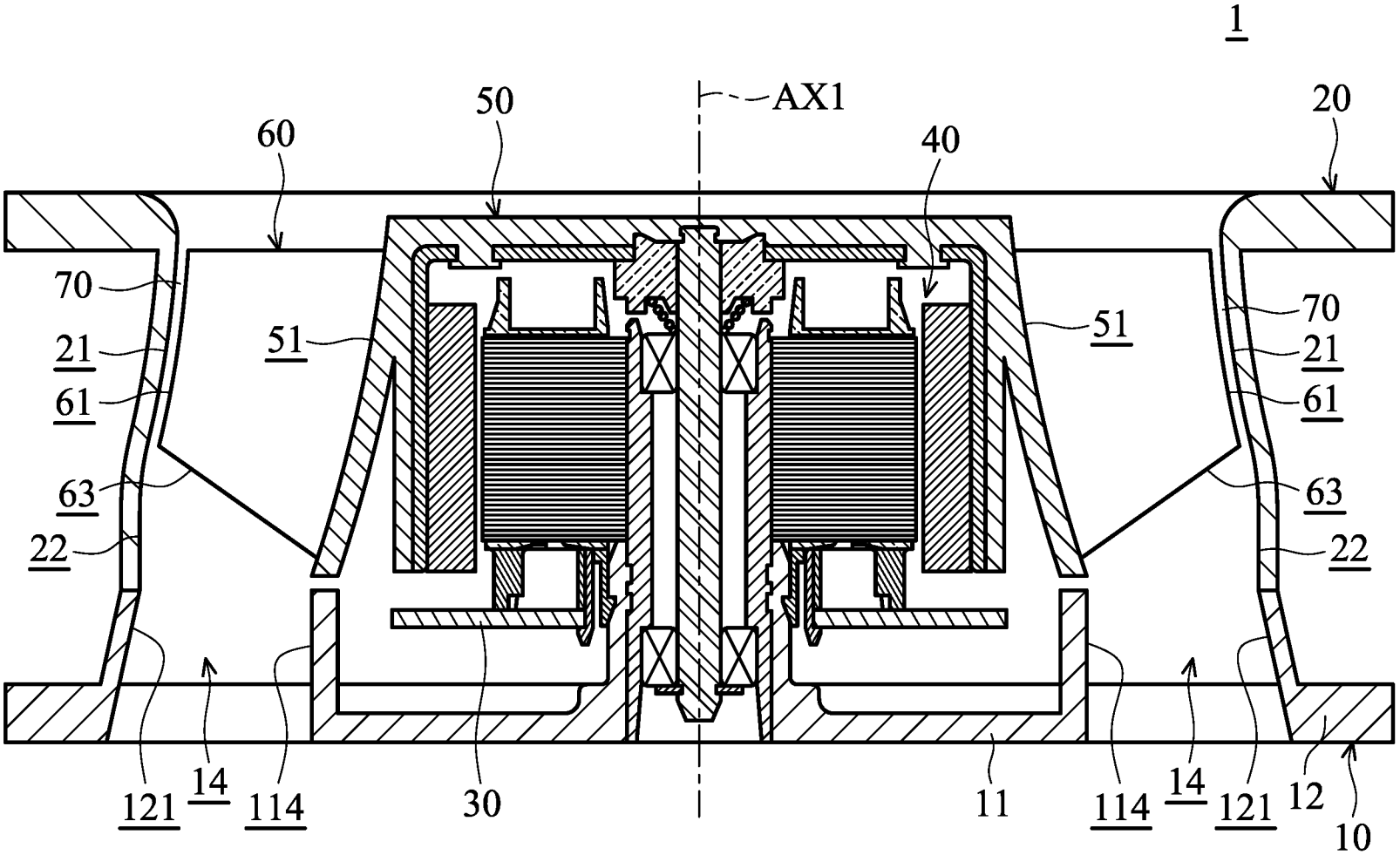
FIG. 8 is a cross-sectional view of the mixed-flow fan in accordance with fifth embodiment of the present disclosure.

FIG. 8 is a cross-sectional view of the mixed-flow 1 fan in accordance with the fifth embodiment of the present disclosure. In the fifth embodiment, in contrast to the fourth embodiment, the blades 60 does not includes the second edge 62. The bottom edge 63 is connected to the first edge 61 and the second outer surface 52. The second outer surface 52 faces the bottom edge 63.

Figure 9:
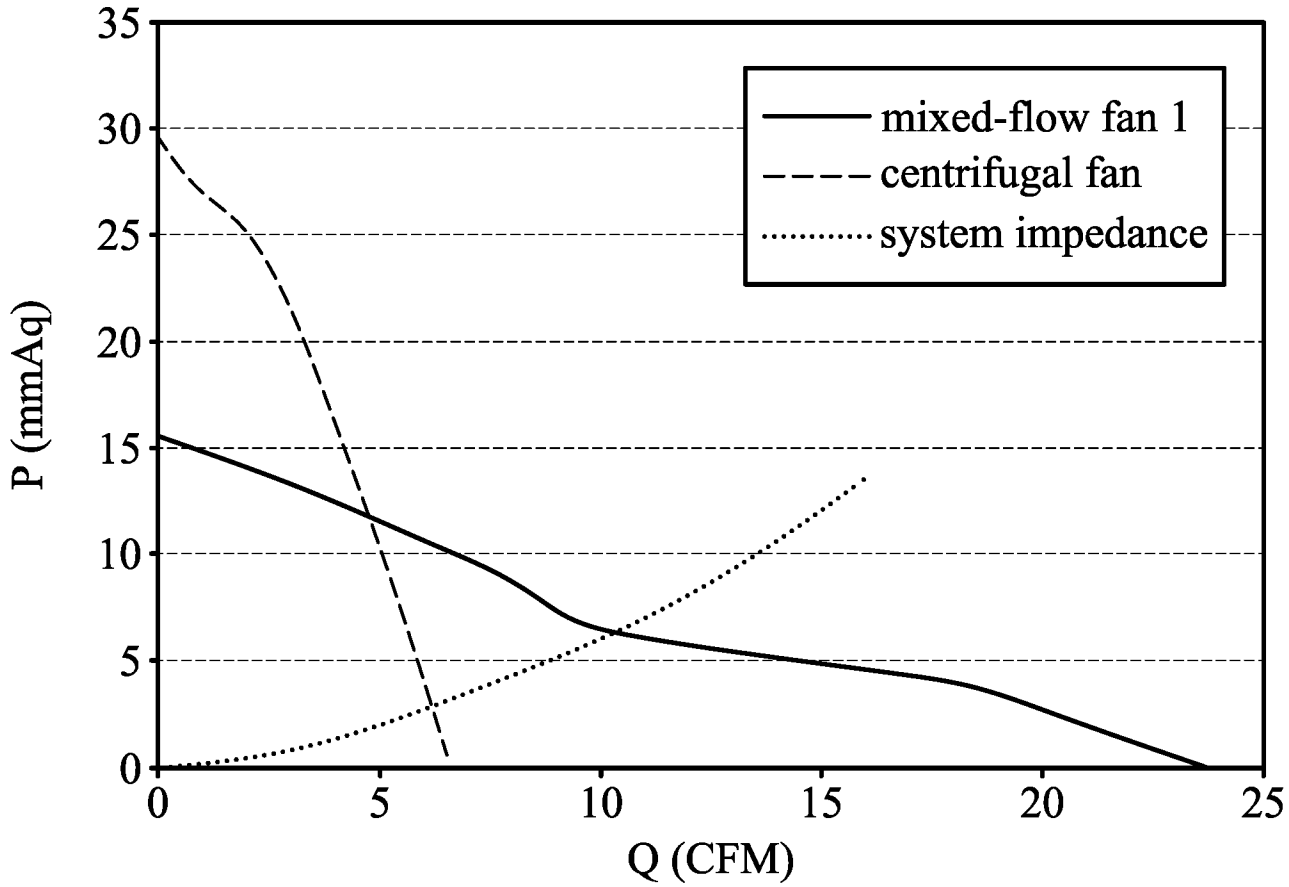
FIG. 9 is a data diagram of wind tunnel experiment of the mixed-flow fan of the disclosure and a conventional centrifugal fan.

FIG. 9 is a data diagram of wind tunnel experiment of the mixed-flow fan 1 of the disclosure and a conventional centrifugal fan. As shown in FIG. 9, the mixed-flow fan 1 and the conventional centrifugal fan are substantially the same size. During the experiment in the system impedance, the strength of the air flow of the conventional centrifugal fan is about 6 CFM, whereas the strength of the air flow of the mixed-flow fan 1 of the disclosure is about 10 CFM. Therefore, depending on the design of the main channel 70 and of the bottom channel 14, the strength of the air flow of the mixed-flow fan 1 is improved. Moreover, at the same rotation speed (such as 5900 RPM), the noise of the mixed-flow fan 1 of the disclosure is about 38.7 dBA, and the noise of the conventional centrifugal fan is about 43 dBA. Therefore, the noise of the mixed-flow fan 1 of the disclosure is lower than the noise of the conventional centrifugal fan.

In conclusion, depending on the design of the main channel and of the bottom channel of the mixed-flow fan of the disclosure, the mixed-flow fan of the disclosure has a larger air flow than the conventional centrifugal fan.

While the invention has been described by way of example and in terms of preferred embodiment, it should be understood that the invention is not limited thereto. On the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. A mixed-flow fan, comprising:

a base;

an outer cover disposed on the base;

a motor disposed on the base, and located in the outer cover;

a hub located between the outer cover and the motor, wherein the hub is configured to rotate about a central axis, wherein the hub comprises a first outer surface and a second outer surface connected to the first outer surface and inclined relative to the first outer surface, and a slope of the first outer surface relative to the central axis is greater than a slope of the second outer surface relative to the central axis; and a blade connected to the first outer surface and the second outer surface;

wherein the base comprises a first side surface adjacent to the second outer surface, and a slope of the first side surface relative to the central axis is equal to the slope of the second outer surface relative to the central axis.

2. The mixed-flow fan as claimed in claim 1, wherein an area of the first outer surface is from 2 times to 10 times an area of the second outer surface.

3. The mixed-flow fan as claimed in claim 1, wherein the blade further comprises a first edge and a second edge connected to the first edge and inclined relative to the first edge, and a slope of the first edge relative to the central axis is greater than a slope of the second edge relative to the central axis.

4. The mixed-flow fan as claimed in claim 3, wherein the second edge is closer to the base than the first edge, and the first edge has a length that is 2 times greater than a length of the second edge.

5. The mixed-flow, fan as claimed in claim 1, wherein the outer cover comprises a first inner surface facing the first outer surface and a second inner surface facing the second outer surface, and a slope of the first inner surface relative to the central axis is greater than a slope of the second inner surface relative to the central axis.

6. The mixed-flow fan as claimed in claim 5, wherein the first outer surface is a concave surface, and the first inner surface is a convex surface.

7. The mixed-flow fan as claimed in claim 1, wherein the blade is a wing-shaped structure, and the blade has a various thickness.

8. The mixed-flow fan as claimed in claim 1, wherein the base comprises a bottom channel, and a main channel is formed between the outer cover and the hub and connected to the bottom channel, wherein the main channel substantially extends in a first direction, the bottom channel substantially extends in a second direction, and a first interior angle between the first direction and the central axis is greater than a second interior angle between the second direction and the central axis.

9. A mixed-flow fan, comprising:

a base;

an outer cover disposed on the base;

a motor disposed on the base, and located in the outer cover; and a hub located between the outer cover and the motor, wherein the hub is configured to rotate about a central axis, wherein the hub comprises a first outer surface and a second outer surface connected to the first outer surface and inclined relative to the first outer surface, and a slope of the first outer surface relative to the central axis is greater than a slope of the second outer surface relative to the central axis;

wherein the base comprises a first side surface adjacent to the second outer surface, and a slope of the first side surface relative to the central axis is equal to the slope of the second outer surface relative to the central axis;

wherein the base further comprises a bottom channel, and a main channel is formed between the outer cover and the hub and connected to the bottom channel, wherein the main channel substantially extends in a first direction, the bottom channel substantially extends in a second direction, and a first interior angle between the first direction and the central axis is greater than a second interior angle between the second direction and the central axis.

10. The mixed-flow fan as claimed in claim 9, wherein the main channel comprises a main inlet and a main outlet opposite to the main inlet, and the main outlet is connected to the bottom channel;

wherein the main channel gradually narrows from the main inlet to the main outlet.

11. The mixed-flow fan as claimed in claim 10, wherein the main inlet and the main outlet are ring-shaped.

12. The mixed-flow fan as claimed in claim 9, wherein the first interior angle is greater than 20 degrees, and the second interior angle is less than 15 degrees.

13. The mixed-flow fan as claimed in claim 9, wherein the base comprises:

a first base body, wherein the motor is disposed on the first base body;

a second base body surrounding the first base body, and separated from the first base body; and a support rib connected to the first base body and the second base body, wherein the bottom channel is formed between the first base body and the second base body, and the support rib is located in the bottom channel.

14. The mixed-flow fan as claimed in claim 13, further comprising a circuit board connected to the motor, wherein the first base body comprises a receiving groove, and the circuit hoard is located in the receiving groove.

15. The mixed-flow fan as claimed in claim 14, wherein the mixed-flow fan has a thickness that is less than 10 times a depth of the receiving groove, and the depth and the thickness are measured in a longitudinal direction parallel to the central axis.

16. The mixed-flow fan as claimed in claim 13, wherein the first base body has a diameter that is 1.6 times greater than a diameter of the motor, and the diameter of the first base body and the diameter of the motor are measured in a transversal direction perpendicular to the central axis.

17. The mixed-flow fan as claimed in claim 13, wherein the first base body comprises the first side surface, the second base body comprises a second side surface facing the first side surface, and the bottom channel is formed between the first side surface and the second base surface; and wherein a first angle between an extension direction of the first side surface and the central axis is less than or equal to a second angle between an extension direction of the second side surface and the central axis.

18. The mixed-flow fan as claimed in claim 17, wherein the second base body is a ring structure perpendicular to the central axis.

19. A mixed-flow fan, comprising:

a base;

an outer cover disposed on the base;

a motor disposed on the base, and located in the outer cover;

a hub located between the outer cover and the motor, wherein the hub is configured to rotate about a central axis, and comprises an outer surface; and a blade connected to the outer surface;

wherein the base comprises a first side surface adjacent to the outer surface, and a slope of the outer surface relative to the central axis is greater than a slope of the first side surface relative to the central axis;

wherein the blade further comprises a first edge and a second edge connected to the first edge and inclined relative to the first edge, and a slope of the first edge relative to the central axis is greater than a slope of the second edge relative to the central axis;

wherein the second edge is closer to the base than the first edge, and a length of the first edge is more than 2 times longer than a length of the second edge.

20. The mixed-flow fan as claimed in claim 19, wherein the base further comprises a second side surface facing the first side surface, and the second side surface is inclined relative to the first side surface.

* * * * *